United States Patent [19]

Banta et al.

[11] 4,298,458

[45] Nov. 3, 1981

[54] LOW PRESSURE HYDROTREATING OF RESIDUAL FRACTIONS

[75] Inventors: Frederick Banta, Elmer; Donald Milstein, Cherry Hill; Alan W. Peters, Morrestown, all of N.J.

[73] Assignee: Mobil Oil Corporation, New York, N.Y.

[21] Appl. No.: 124,017

[22] Filed: Feb. 25, 1980

[51] Int. Cl.[3] ..... C10G 47/12; C10G 45/08

[52] U.S. Cl. ..... 208/112; 208/89; 208/215; 208/251 H; 208/254 H; 208/264

[58] Field of Search ..... 208/112, 213, -217, 208/57-61, 89, 251 H, 254 H

[56] References Cited

U.S. PATENT DOCUMENTS

| | | | |
|---|---|---|---|
| 3,910,834 | 10/1975 | Anderson | 208/59 |
| 4,115,248 | 9/1978 | Mulaskey | 208/112 |
| 4,176,051 | 11/1979 | Ternan et al. | 208/112 |

*Primary Examiner*—Delbert E. Gantz
*Assistant Examiner*—G. E. Schmitkons
*Attorney, Agent, or Firm*—Charles A. Huggett; Michael G. Gilman; Charles J. Speciale

[57] ABSTRACT

Cyclic hydrotreating of resids with low pressure, short term on-stream periods yields desirable products.

5 Claims, No Drawings

LOW PRESSURE HYDROTREATING OF RESIDUAL FRACTIONS

BACKGROUND OF THE INVENTION

1. Field of the Invention

This invention relates to demetalation and desulfurization of petroleum oils, particularly residual hydrocarbon components, and having a significant metals and sulfur content. More particularly the invention relates to a demetalation-desulfurization process for reducing high metals and sulfur contents of residual hydrocarbon fractions with high yield of gasoline and distillate.

2. Description of the Prior Art

Because of the large amounts of sulfur-bearing oils which are currently being employed as raw materials in the petroleum refining industry, the problems of air pollution, particularly with regard to sulfur oxide emissions, have become of increasing concern. This has become particularly true with regard to several high sulfur content feedstocks, particularly those including high-boiling asphaltene components. For these reasons various methods for the removal of sulfur from these feedstocks have been the subject of intensive research efforts by this industry. At present, the most practical commercial means of desulfurizing such fuel oils is the catalytic hydrogenation of sulfur-containing molecules and petroleum hydrocarbon feeds in order to effect the removal, as hydrogen sulfide, of the sulfur-containing molecules therein. These processes generally require relatively high hydrogen pressures, generally ranging from about 2000 to 3000 psig, and elevated temperatures generally ranging upward from 650° F., depending upon the feedstock employed and the degree of desulfurization required.

Such catalytic processes are generally quite efficient for the desulfurization of distillate-type feedstocks, but become of increasing complexity and expense, and decreasing efficiency, as increasingly heavier feedstocks, such as whole or topped crudes and residua are employed. This is particularly true with regard to asphaltene-containing feedstocks, including residuum feedstocks, since such feedstocks are often contaminated with heavy metals, such as nickel, vanadium and iron, as well as with the asphaltenes themselves, which tend to deposit on the catalyst and deactivate same. Furthermore, a large portion of the sulfur content in these feeds is generally contained in the higher molecular weight molecules, which can only be broken down under the more severe operating conditions, and which generally diffuse with difficulty through the catalyst pores.

Residual petroleum oil fractions such as those heavy fractions produced by atmospheric and vacuum crude distillation columns, are typically characterized as being undesirable as feedstocks for most refining processes due primarily to their high metals and sulfur content. The presence of high concentrations of metals and sulfur and their compounds precludes the effective use of such residua as chargestocks for cracking, hydrocracking and coking operations as well as limiting the extent to which such residua may be used as fuel oil. Perhaps the single most undesirable characteristic of such feedstocks is the high metals content. Principal metal contaminants are nickel and vanadium, with iron and small amounts of copper also sometimes present. Additionally, trace amounts of zinc and sodium are found in some feedstocks. As the great majority of these metals when present in crude oil are associated with very large hydrocarbon molecules, the heavier fractions produced by crude distillation contain substantially all the metal present in the crude, such metals being particularly concentrated in the asphaltene residual fraction. The metal contaminants are typically large organo-metallic complexes such as metal prophyrins and asphaltenes.

At present, cracking operations are generally performed on petroleum fractions lighter than residua fractions. Such cracking is commonly carried out in a reactor operated at a temperature of about 800° to 1000° F., a pressure of about 1 to 5 atmospheres, and a space velocity of about 1 to 10 WHSV. Typical cracking chargestocks are coker and/or crude unit gas oils, vacuum tower overhead etc., the feedstock having an API gravity range of between about 15 to about 45. As these cracking chargestocks are lighter than residual hydrocarbon fractions, (residual fractions being characterized as having an API gravity of less than about 20) they do not contain significant proportions of the heavy and large molecules in which the metals are concentrated.

When metals are present in a cracking unit chargestock such metals are deposited on the cracking catalyst. The metals act as a catalyst poison and greatly decrease the efficiency of the cracking process by altering the catalyst so that it promotes increased hydrogen production.

The amount of metals present in a given hydrocarbon stream is generally judged by petroleum engineers by making reference to a chargestock's "metals factor." This factor is equal to the summation of the metals concentration in parts per million of iron and vanadium plus ten times the amount of nickel and copper in parts per million. The factor may be expressed in an equation form as follows:

$$F_m = Fe + V + 10(Ni + Cu)$$

A chargestock having a metals factor greater than 2.5 is indicative of a chargestock which will poison cracking catalyst to a significant degree. A typical Kuwait crude generally considered of average metals content, has a metals factor of about 75 to about 100. As almost all of the metals are combined with the residual faction of a crude stock, it is clear that metals removal of 90 percent and greater will be required to make such fractions (having a metals factor of about 150 to 200) suitable for cracking chargestocks.

Sulfur is also undesirable in a process unit chargestock. The sulfur contributes to corrosion of the unit mechanical equipment and creates difficulties in treating products and flue gases. At typical cracking conversion rates, about one half of the sulfur charged to the unit is converted to $H_2S$ gas which must be removed from the light gas product, usually by scrubbing with an amine stream. A large portion of the remaining sulfur is deposited on the cracking catalyst itself. When the catalyst is regenerated, at least a portion of this sulfur is oxidized to form $SO_2$ and/or $SO_3$ gas which must be removed from the flue gas which is normally discharged into the atmosphere.

Such metals and sulfur contaminants present similar problems with regard to hydrocracking operations which are typically carried out on chargestocks even lighter than those charged to a cracking unit, and thus typically having an even smaller amount of metals present. Hydrocracking catalyst is so sensitive to metals poisoning that a preliminary or first stage is often utilized for trace metals removal. Typical hydrocracking reactor conditions consist of a temperature of 400° to 700° F. and a pressure of 1000 to 3500 psig.

In the past, and to a limited extent under present operating schemes, high molecular weight stocks containing sulfur and metal have often been processed in a coker to effectively remove metals and also some of the sulfur, the contaminants remaining in the solid coke. Coking is typically carried out in a reactor or drum operated at about 800° to 1100° F. temperature and a pressure of 1 to 10 atmospheres wherein heavy oils are converted to lighter gas oils, gasoline, gas and solid coke. However, there are limits to the amount of metals and sulfur that can be tolerated in the product coke if it is to be saleable. Hence, there is considerable need to develop economical as well as efficient means for effecting the removal and recovery of metallic and non-metallic contaminants from various fractions of petroleum oils so that conversion of such contaminated charges to more desirable product may be effectively accomplished.

It has been proposed to improve the salability of high sulfur content, residual-containing petroleum oils by a variety of hydrodesulfurization processes. However, difficulty has been experienced in achieving an economically feasible catalytic hydrodesulfurization process, because notwithstanding the fact that the desulfurized products may have a wider marketability, the manufacturer may be able to charge little or no premium for the low sulfur desulfurized products, and since hydrodesulfurization operating costs have tended to be relatively high in view of the previously experienced, relatively short life for catalysts used in hydrodesulfurization of residual-containing stocks. Short catalyst life is manifested by inability of a catalyst to maintain a relatively high capability for desulfurizing chargestock with increasing quantities of coke and/or metallic contaminants which act as catalyst poisons. Satisfactory catalyst life can be obtained relatively easily with distillate oils, but is especially difficult to obtain when desulfurizing petroleum oils containing residual components, since the asphaltene or asphaltic components of an oil, which tend to form disproportionate amounts of coke, are concentrated in the residual fractions of a petroleum oil, and since a relatively high proportion of the metallic contaminants that normally tend to poison catalysts are commonly found in the asphaltene components of the oil.

The greatest deterrent to hydrotreating of residual stocks has been the high costs for construction and operation at the pressures required for reasonable on-stream periods, usually 2000 to 3000 psig.

SUMMARY OF THE INVENTION

It has now been found that product quality is very high during the initial period of hydrotreating residual stocks at low pressures between about 100 to 600 psig and unusually high temperatures, up to about 950° F. This discovery is applied by hydrotreating residua in a cyclic catalyst system at on-stream periods of 6 hrs. to 15 days. The process of the invention is particularly advantageous in making high yields of gasoline and distillate fuel, upwards of 80% based on charge, at the higher portion of the temperature range.

DESCRIPTION OF SPECIFIC EMBODIMENTS

The invention contemplates processing of residual fractions derived from petroleum or like sources by distillation. The residuum or residual fraction is the still bottoms, boiling above 650° F., remaining after distillation of those portions of the source materials ("distillates") which can be vaporized without substantial thermal cracking in atmospheric or vacuum fractionation towers.

The catalyst used according to the invention is any of the conventional hydrotreating catalysts constituted by a metal of Group VI B, such as molybdenum or tungsten, together with a metal from the first period of Group VIII preferably cobalt or nickel, on a porous alumina support. Such catalysts have negligible acid activity of the type characterizing hydrocracking catalysts, but when used in the preferred mode of the invention at temperatures of 850°–950° F. and low pressure of 100–600 psig, preferably 100–300 psig, the process yields a liquid product primarily constituted by gasoline and distillate fuel boiling below 650° F., a result like that of hydrocracking. That preferred embodiment is hereinafter referred to as the gasoline plus distillate or "G+D" mode of operations.

The process may also be conducted with primary interest in demetallization ("demet mode") or desulfurization ("deS mode") or both as in preparation of catalytic cracking feedstock for the FCC or like process. In these modes, the process preferably operates at the pressures stated for the G+D mode but at lower temperature in the range of about 750°–850° F.

Space velocity in conducting processes according to the invention are those usual in the hydrotreating art, from about 0.1 to about 5.0 WHSV.

The hydrogen gas which is used during the hydrode metalation-hydrodesulfurization is circulated at a rate between about 1000 to 15,000 s.c.f./bbl of feed. The hydrogen purity may vary from about 60 to 100 percent. If the hydrogen is recycled, which is customary, it is desirable to provide for bleeding off a portion of the recycle gas and to add makeup hydrogen in order to maintain the hydrogen purity within the range specified. Satisfactory removal of hydrogen sulfide from the recycled gas will ordinarily be accomplished by such bleed-off procedures. However, if desired, the recycled gas can be washed with a chemical absorbent for hydrogen sulfide or otherwise treated in known manner to reduce the hydrogen sulfide content thereof prior to recycling.

The hydrogenating component of the class of catalysts disclosed herein can be any material or combination thereof that is effective to hydrogenate the chargestock under the reaction conditions utilized. For example, the hydrogenating component can be at least one member of the group consisting of Group VI and Group VIII metals in a form capable of promoting hydrogenation reactions, especially effective catalysts for the purposes of this invention are those comprising molybdenum and at least one member of the iron group metals. Preferred catalysts of this class are those containing cobalt and molybdenum, but other combinations of iron group metals and molybdenum such as iron, zinc, nickel and molybdenum, as well as combinations of nickel and molybdenum, cobalt and molybdenum, nickel and tungsten or other Group VI or Group VIII metals of the Periodic Table taken singly or in combination. The hydrogenating components of the catalysts of this invention can be employed in sulfided or unsulfided form.

When the use of a catalyst in sulfided form is desired, the catalyst can be presulfided, after calcination, or calcination and reduction, prior to contact with the chargestock, by contact with sulfiding mixture of hydrogen and hydrogen sulfide, at a temperature in the range of about 400° to 800° F., at atmospheric or elevated pressures. Presulfiding can be conveniently effected at the beginning of an onstream period at the same conditions to be employed at the start of such period. The exact proportions of hydrogen and hydrogen sulfide are not critical, and mixtures containing low or high proportions of hydrogen sulfide can be used. Relatively low proportions are preferred for economic reasons. When the unused hydrogen and hydrogen sulfide utilized in the presulfiding operation is recycled through the catalyst bed, any water formed during presulfiding is preferably removed prior to recycling through the catalyst bed. It will be understood that elemental sulfur or sulfur compounds, e.g. mercaptans, or carbon disulfide that are capable of yielding hydrogen sulfide at the sulfiding conditions, can be used in lieu of hydrogen sulfide.

Although presulfiding of the catalyst is preferred, it is emphasized that this is not essential as the catalyst will normally become sulfided in a very short time by contact, at the process conditions disclosed herein, with the high sulfur content feedstocks to be used.

The support for the metal hydrogenation catalyst is any of the porous alumina compositions conventionally used for this purpose. The support has negligible catalytic activity for hydrocarbon conversion and may vary in character of pores depending on the method of preparation. Usually the support will have a surface area of approximately 40 to 300 $m^2/g$. Pore sizes will be predominantly in the range of 50–300 A in diameter.

The catalyst is prepared by impregnating one or more hydrogenation components on the refractory alumina support, in a preferred embodiment cobalt and molybdenum on a theta or delta phase alumina base.

The term of the on-stream period is important in achieving the benefits of the invention. The term may range from two hours to about fifteen days and will be terminated within that range depending on inspection of the product for characteristics described below with respect to the different modes of operation.

When operating in the G+D mode, the contact of charge stock and hydrogen with the catalyst is preferably terminated when inspection of the reactor effluent indicates that conversion of charge stock to liquid product in the range of $C_5$ to 650° F. boiling point (gasoline plus distillate) is less than 80% by volume. The determination of conversion is preferably made by stream analyzers as well known in the art. In its broader aspects, the G+D mode may be run to conversion levels as low as 50%, but it is preferred to gain maximum advantage by terminating contact of charge and catalyst at conversion levels not lower than 80%.

One suitable style for conducting the process involves use of at least two, preferably three, reactors in parallel. At least one reactor is on stream at all times, permitting continuous operation of charge heaters and downstream product recovery facilities, while one or more reactors are being regenerated by burning deposits from the catalyst with air or other oxidizing gas. Alternatives to such cycling of the feed from one reactor to the next may employ any of the systems for cycling catalyst between the reactor and a separate regenerator. For example, systems have been used commercially for circulation of catalyst by moving bed and by fluidized solids techniques in catalytic reforming at hydrogen pressures in the range contemplated by the invention. The equipment described for that purpose, modified to accommodate liquid feed may be used in practice of the invention. Also suited to the purpose is the "ebullating bed" type of apparatus. Whatever type of apparatus may be used, the term during which the catalyst remains in contact with charge is limited in the manner stated above. With such systems as fulidized solids and ebullated beds, that contact time will be an average of the contact times experienced by the individual particles of catalyst as well known in the art.

Similarly the term during which catalyst remains in contact with charge will be limited in demet and deS modes of operation. In conducting the demet mode, as for preparation of FCC charge stock, termination will be set at 10 ppm or less of metal, preferably less than 5 ppm. Runs in the deS mode, as in processing for heavy fuel oil, will be terminated at a point below 1% sulfur in the product, preferably below 0.5% sulfur.

Whatever manner of cyclic operation is selected, the invention provides an advantageous use of hydrotreating catalyst at low pressure and high temperature over a short period of exposure of catalyst to charge plus hydrogen, regeneration of the catalyst and return of regenerated catalyst to further short time contact of catalyst with charge and hydrogen at like conditions of low pressure and high temperature.

EXAMPLES

A series of runs carried out for conversion of Arabian Light vacuum resid at 200–600 psig illustrate the advantages of the invention as summarized above. At high temperature (900° F.) the resid is converted to gasoline in an amount of about 50% by volume and distillate of about 35% by volume. Very little product boiling above 650° F. (about 15%) is found. The results are tabulated in Table 1 below together with two other runs at lower temperature over the same commercial cobalt-molybdenum or alumina catalyst. The table also includes inspection data on the charge for all three runs and, in the last column, typical data on conventional hydrotreating of the same charge over the same catalyst.

TABLE I

LOW-PRESSURE HYDROPROCESSING OF ARABIAN LT.VACUUM RESID

| Example | Charge Stock | 1 | 2 | 3 | Conventional HDT |
|---|---|---|---|---|---|
| Temperature, °F. | — | 900 | 800 | 700 | 725 |
| Pressure, psig | — | 200 | 600 | 200 | 2000 |
| Space Velocity, LHSV | — | 0.45 | 0.32 | 0.46 | 0.28 |
| $H_2$ Circulation SCF/B | — | 9610 | 14,300 | 9320 | |
| Time on Stream, HRS | — | 2 | 36 | 8 | |
| Yields, % WT | | | | | |
| $H_2S + NH_3$ | — | 4.4 | 3.2 | 3.6 | |
| Dry Gas | — | 8.0 | 1.2 | 0.3 | |

TABLE I-continued

LOW-PRESSURE HYDROPROCESSING OF ARABIAN LT.VACUUM RESID

| Example | Charge Stock | 1 | 2 | 3 | Conventional HDT |
|---|---|---|---|---|---|
| Coke | — | 6.0 | — | — | |
| $C_4$ | — | 5.1 | 0.7 | 0.1 | |
| $C_5^+$ | — | 77.9 | 96.2 | 96.9 | |
| Total | | 101.4 | 101.3 | 100.9 | |
| $H_2$ Consumption SCF/B | — | 970 | 850 | 640 | |
| Yields, % Vol | | | | | |
| i-$C_4$ | — | 8.3 | 1.1 | 0.1 | |
| $C_5^+$ | — | 89.9 | 104.9 | 102.3 | |
| Total | — | 98.2 | 106.0 | 102.4 | |
| Product Properties | | | | | |
| Gravity, % API | 8.5 | 29.8 | 21.3 | 16 (est.) | 11.8 |
| Sulfur, % WT | 3.88 | 0.75 | 1.20 | 1.20 | 0.69 |
| Nitrogen, % WT | 0.26 | 0.052 | 0.20 | 0.20 | 0.15 |
| Hydrogen, % WT | 10.50 | 11.90 | 11.60 | 11.60 | 11.88 |
| CCR, % WT | 17.0 | — | 7.0 | 7.2 | 7.0 |
| Ni, PPM WT | 18 | — | 5 | 5 | 4.6 |
| V, PPM WT | 68 | — | 1.5 | 1.5 | 7.0 |
| Distillation, D2887 | | | | | |
| IBP/10% | 688/868 | 84/225 | 143/436 | — | |
| 20/30 | 904/930 | 276/315 | 588/692 | — | |
| 40/50 | 951/— | 351/389 | 775/841 | — | |
| 60/70 | — | 428/477 | 892/929 | — | |
| 80/90 | — | 560/785 | 954/995 | — | |
| 95/FBP | — | 899/982 | 1004/1011 | — | |

We claim:

1. In a process for hydrotreating of residual charge stock boiling above 650° F. to reduce sulfur, nitrogen and metal contaminants by contacting said charge stock and hydrogen with a fixed bed of a catalyst consisting essentially of a hydrogenation component supported on porous alumina at elevated temperature and pressure; the improvement for enhanced concurrent production of gasoline and distillate boiling below about 650° F. which comprises conducting said contacting at a high temperature of 850° to 950° F., a low pressure of 100 to 600 psig during a short contact period of high catalyst activity for production of gasoline and distillate at said conditions of temperature and pressure between about two hours and fifteen days, terminating said contacting at the end of said period, regenerating said catalyst by oxidation of combustible deposits thereon and again contacting the regenerated catalyst with said charge stock and hydrogen.

2. A process according to claim 1 wherein said contacting is terminated while the product of said contacting contains at least 50% by volume based on said charge of liquid product boiling below 650° F.

3. A process according to claim 1 wherein said contacting is terminated while the product of said contacting contains at least 80% by volume based on said charge of liquid product boiling below 650° F.

4. A process according to claim 1 wherein said pressure is 100 to 300 psig.

5. A process according to claim 1 wherein said pressure is about 200 psig.

* * * * *

UNITED STATES PATENT AND TRADEMARK OFFICE

CERTIFICATE OF CORRECTION

PATENT NO. : 4,298,458

DATED : November 3, 1981

INVENTOR(S) : Frederick BANTA ET AL

It is certified that error appears in the above—identified patent and that said Letters Patent is hereby corrected as shown below:

Column 6, line 21, change "fulidized" to ---fluidized---

Column 7, line 16, change "Gravity, % API" to ---Gravity, °API---

Column 7, line 16, last column of table, change "11.8" to ---17.8---

Signed and Sealed this

*Eighteenth* Day of *May 1982*

[SEAL]

*Attest:*

GERALD J. MOSSINGHOFF

*Attesting Officer*

*Commissioner of Patents and Trademarks*